US006871806B2

(12) United States Patent
Tsai et al.

(10) Patent No.: US 6,871,806 B2
(45) Date of Patent: Mar. 29, 2005

(54) NANOMATERIAL PROCESSING SYSTEM

(75) Inventors: I-Shou Tsai, Taichung (TW); Pen-Yi Liao, Hualien (TW); Chin-Chun Chou, Taichung (TW); Wen-I Kuo, Taichung (TW); Lei-Ti Huang, Taichung (TW)

(73) Assignees: Yeu Ming Tai Chemical Industrial Co., Ltd., Taichung (TW); Precision Machinery Research and Development Center, Taichung (TW)

( * ) Notice: Subject to any disclaimer, the term of this patent is extended or adjusted under 35 U.S.C. 154(b) by 95 days.

(21) Appl. No.: 10/423,925

(22) Filed: Apr. 28, 2003

(65) Prior Publication Data

US 2004/0182956 A1 Sep. 23, 2004

(51) Int. Cl.[7] ..... B02C 19/06

(52) U.S. Cl. ..... 241/39; 241/5; 241/101.2; 977/DIG. 1

(58) Field of Search ..... 241/5, 39, 101.2

(56) References Cited

U.S. PATENT DOCUMENTS 6,318,649 B1 * 11/2001 Mazurkiewicz ..... 241/5

2003/0228464 A1 * 12/2003 Spitler et al. ..... 428/403

FOREIGN PATENT DOCUMENTS

WO WO 98/36840 * 8/1998

* cited by examiner

*Primary Examiner*—Mark Rosenbaum
(74) *Attorney, Agent, or Firm*—Browdy and Neimark, P.L.L.C.

(57) ABSTRACT

A nanomaterial processing system is constructed to include a compressor adapted to compress a flow of air/liquid into a high-pressure flow of air/liquid, a material feeder adapted to feed a material into the high-pressure flow of air/liquid passing out of the compressor, enabling the fed material to be mixed with the high-pressure flow of air/liquid into a high-pressure material flow; a shunt collider adapted to shunt the high-pressure material flow into two sub-flows and to let the shunt sub-flows to collide into a collided material flow, and a high-speed cutting unit, which uses a diamond coating-coated cutting wheel to cut solid substances the collided material flow.

5 Claims, 3 Drawing Sheets

NANOMATERIAL PROCESSING SYSTEM

BACKGROUND OF THE INVENTION

1. Field of the Invention

The present invention relates generally to nanotechnology and, more specifically, to a nanomaterial processing system for processing nanomaterials.

2. Description of the Related Art

Currently, the fabrication of nanomaterials commonly uses a nanopowder as base material, which is obtained by means of molecule collision, grinding, cutting or, or the application of an electric arc. Either molecule collision, grinding or liquid cutting, the particles of a nanopowder made according to the conventional methods have a certain size. For example, the particle size is about 20~60 nanometers when made by means of molecule collision; or about 40~120 nanometers when made by means of grinding. The equipment cost will be relatively higher when wishing to reduce the particle size.

SUMMARY OF THE INVENTION

The present invention has been accomplished under the circumstances in view. It is the main object of the present invention to provide a nanomaterial processing system, which is practical for processing nanomaterials. It is still another object of the present invention to provide a nanomaterial processing system, which is simple and cost-effective.

To achieve these and other objects of the present invention, the nanomaterial processing system comprises compressor means adapted to compress a flow of air/liquid into a high-pressure flow of air/liquid, the compressor means having an inlet for the input of the flow of air/liquid and an outlet for the output of the high-pressure flow of air/liquid; a material feeder adapted to feed a material into the high-pressure flow of air/liquid passing out of the outlet of the compressor means, enabling the fed material to be mixed with the high-pressure flow of air/liquid into a high-pressure material flow; a shunt collider, the shun collider comprising a shunt unit connected to the material feeder and adapted to shunt the high-pressure material flow into two sub-flows, a collider unit, two jet nozzles respectively extended from the shunt unit and adapted to send out the two sub-flows, causing the two sub-flows to collide in the collider unit, and an output port for outputting the collided material flow from the collider unit to a high-speed cutting unit; and a high-speed cutting unit connected to the output port of the shunt collider, the high-speed cutting unit comprising a diamond coating-coated cutting wheel disposed at a contained angle within about 10~170~° relative to the collided material flow outputted from the output port of the shunt collider for cutting solid substances in the collided material flow.

DETAILED DESCRIPTION OF THE INVENTION

Figure 1:
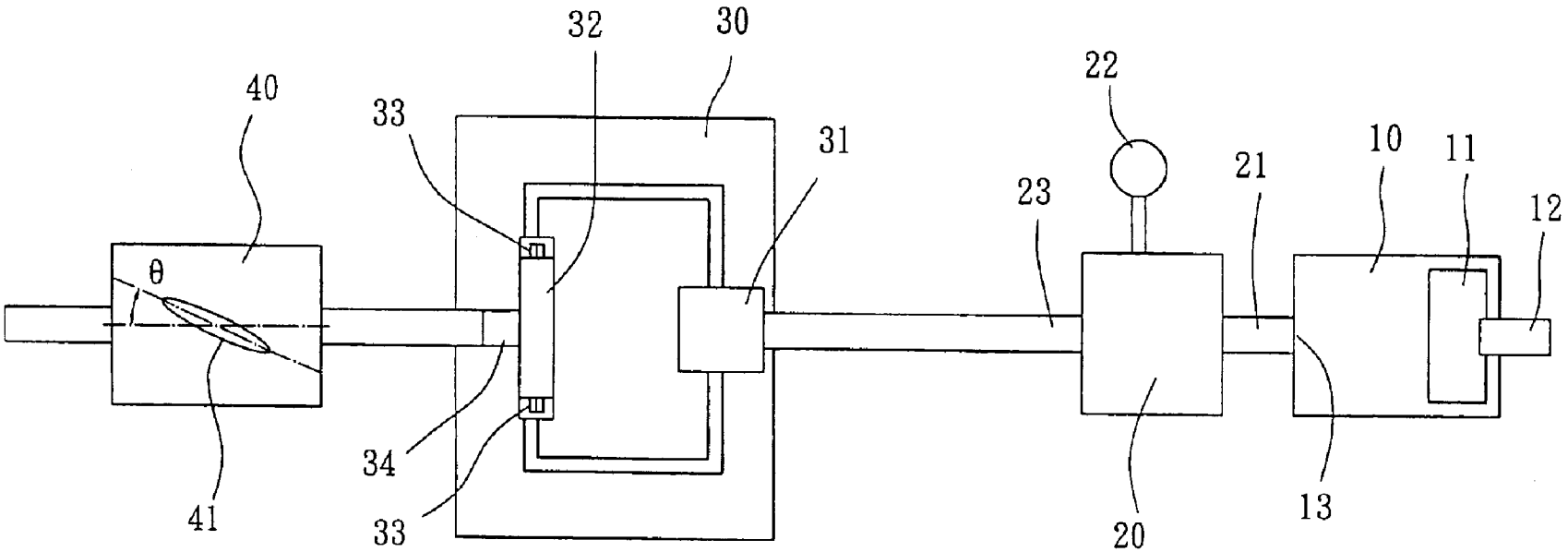
FIG. 1 is a block diagram of a nanomaterial processing system according to a first embodiment of the present invention.

Referring to FIG. 1, a nanomaterial processing system in accordance with the first embodiment of the present invention is shown comprised of a compressor 10, a material feeder 20, a shunt collider 30, and a high-speed cutting unit 40.

The compressor 10 can be an air compressor or fluid compressor. According to this embodiment, the compressor 10 is a fluid compressor adapted to add pressure to a fluid by means of a high R/R ratio compressing method. The output pressure value of the compressor 10 is about 20000~25000 PSI. The compressor 10 has a liquid inlet 12 disposed at one end and mounted with a filter 11, and a liquid outlet 13 disposed at the other end.

The material feeder 20 has a first high-pressure pipe 21 extended from one end thereof and connected to the liquid outlet 13 of the compressor 10 and adapted to receive compressed fluid from the compressor 10 and to suck raw material into the intake flow of compressed fluid by means of high-pressure flow siphon effect, for enabling raw material to be mixed with the intake flow of compressed fluid to provide a material flow for output to the shunt collider 30. The material feeder 20 further comprises a second high-pressure pipe 23 extended from the other end thereof for output of the material flow, and a pressure gauge 22, which measures the pressure of the intake flow of compressed fluid.

The shunt collider 30 comprises a shunt unit 31 connected to the second high-pressure pipe 23 of the material feeder 20 and adapted to shunt the material flow from the material feeder 20 into two sub-flows, a collider unit 32, two jet nozzles 33 respectively extended from the shunt unit 31 and adapted to send out the two sub-flows causing the two sub-flows to collide in the collider unit 32, and an output port 34 for outputting the collided material flow from the collider unit 32 to the high-speed cutting unit 40.

The high-speed cutting unit 40 is connected to the output port 34 of the collider unit 32 of the shunt collider 30, comprising a diamond coating-coated cutting wheel 41, which is disposed at a predetermined contained angle θ relative to the collided material flow outputted from the output port 34 of the collider unit 32 to the high-speed cutting unit 40. The contained angle θ can be set within 10~170°, or preferably at 35°. The speed of the diamond coating-coated cutting wheel 41 is set within 8000~10000 rpm.

When a compressed flow of fluid passing out of the water outlet 13 of the compressor 10 into the high-pressure pipe 21 of the material feeder 20, the material to be processed, for example, titanium dioxide powder or ceramics of particle size within 200~500 mm is sucked into the high-pressure pipe 21 and mixed with the compressed flow of fluid, forming a compressed flow of material fluid, which is then shunted into two sub-flows of material fluid by the shunting unit 31 and then ejected into the collider unit 32 by through the two jet nozzles 33 at the pressure of 20000~22000 PSI, thereby causing the two sub-flows of material fluid to collide into particle size within about 20~40 nanometers in the collider unit 32. The collided material flow is then guided out of the output port 34 of the collider unit 32 into the high-speed cutting unit 40. Because the collided material flow has a high-pressure, it rushes out of the output port 34 against the rotating high-speed cutting unit 40 at a high speed, enhancing the spreading and emulsifying of solid substances in the collided material flow.

Figure 2:
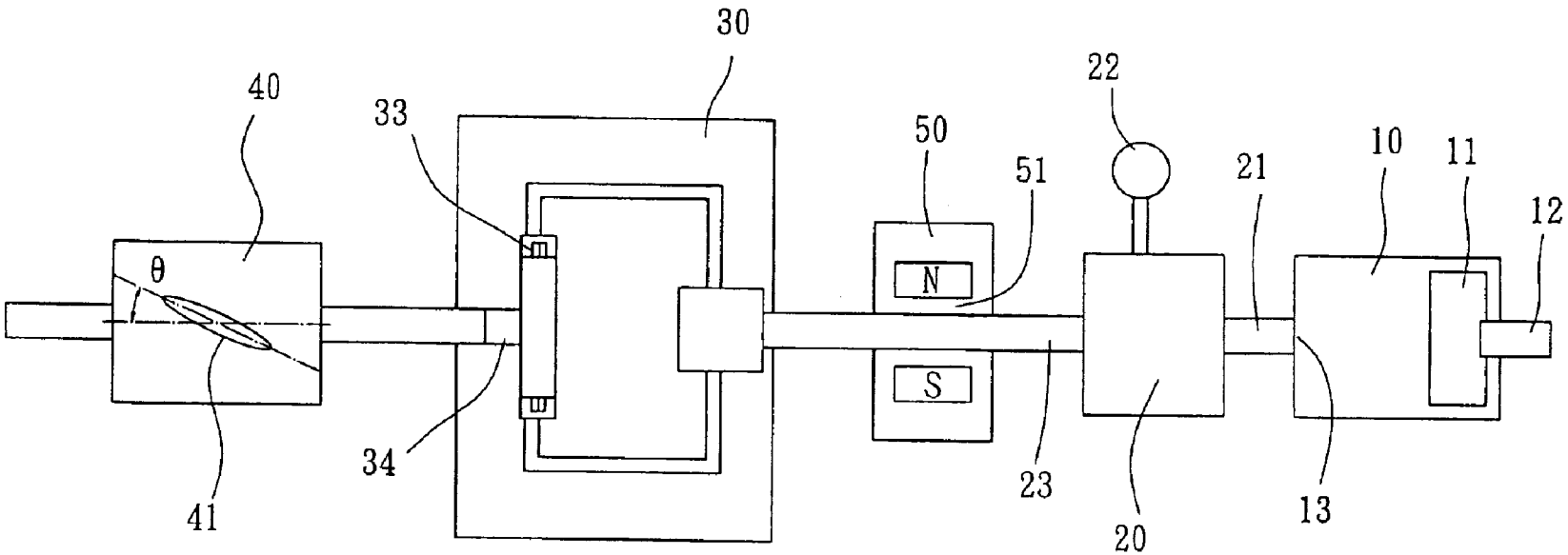
FIG. 2 is a block diagram of a nanomaterial processing system according to a second embodiment of the present invention.

FIG. 2 is a block diagram of the nanomaterial processing system according to the second embodiment of the present invention. According to this embodiment, a magnetizer 50 is installed in the second high-pressure pipe 23, and adapted to generate a magnetic field that magnetize the material flow passing through the second high-pressure pipe 23 to the shunt collider 30, causing group molecules of water to reduce from 100~170 Hz to 50~80 Hz and to facilitate further processing.

By means of the application of the simple, inexpensive nanomaterial processing system, materials can efficiently and economically processed into fine nanopowder.

Figure 3:
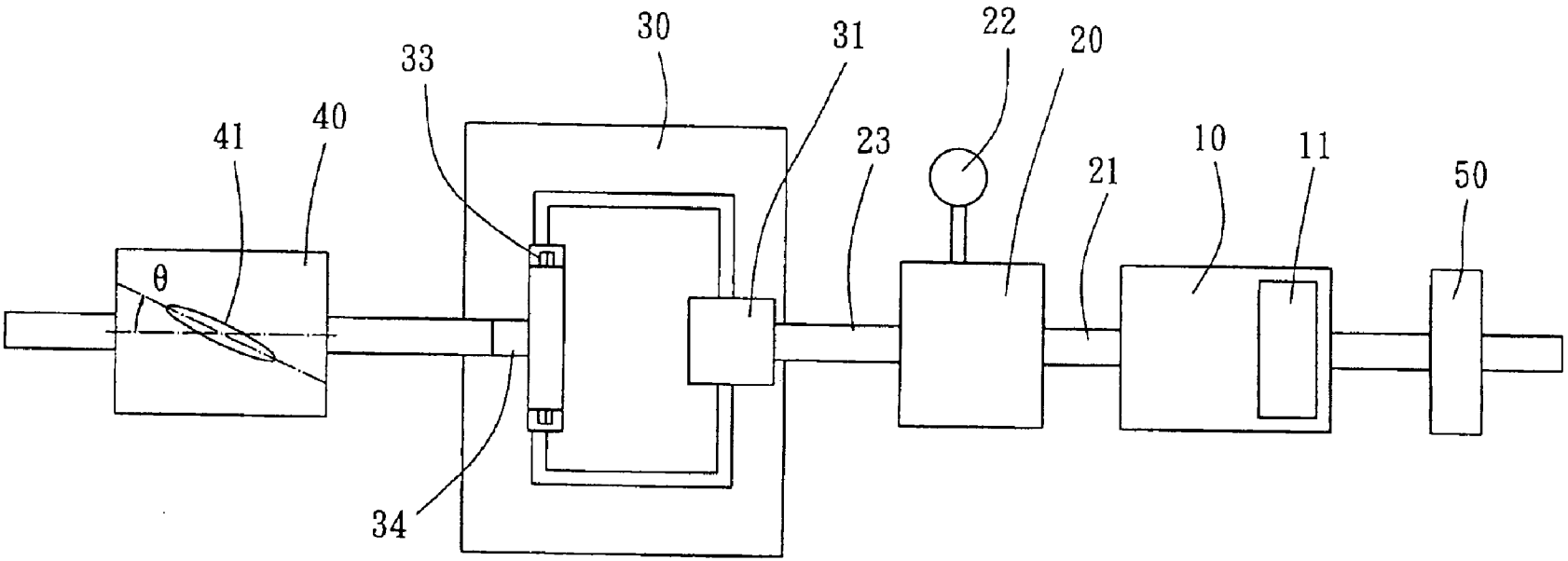
FIG. 3 is a block diagram of a nanomaterial processing system according to a third embodiment of the present invention.

FIG. 3 is a block diagram of the nanomaterial processing system according to the third embodiment of the present invention. According to this embodiment, a gas source 50 is provided in front of the compressor 10, and adapted to add a suitable amount of inert gas, for example, helium or neon to the fluid passing through the compressor 10. The added inert gas protects the processed nanopowder against oxidation. Alternatively, another kind of gas, for example, ozone, deuterium or tritium may be added to the intake flow of fluid to change the physical properties of the material to be processed.

A prototype of nanomaterial processing system has been constructed with the features of FIGS. 1~3. The nanomaterial processing system functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A nanomaterial processing system comprising:

a compressor means adapted to compress a flow of air/liquid into a high-pressure flow of air/liquid, said compressor means having an inlet for the input of said flow of air/liquid and an outlet for the output of said high-pressure flow of air/liquid;

a material feeder adapted to feed a material into the high-pressure flow of air/liquid passing out of the outlet of said compressor means, enabling the fed material to be mixed with the high-pressure flow of air/liquid into a high-pressure material flow;

a shunt collider, said shunt collider comprising a shunt unit connected to said material feeder and adapted to shunt said high-pressure material flow into two sub-flows, a collider unit, two jet nozzles respectively extended from said shunt unit and adapted to send out said two sub-flows, causing said two sub-flows to collide in said collider unit, and an output port for outputting the collided material flow from said collider unit to a high-speed cutting unit; and a high-speed cutting unit connected to the output port of said shunt collider, said high-speed cutting unit comprising a diamond coating-coated cutting wheel disposed at a contained angle within about 10~170° relative to the collided material flow outputted from the output port of said shunt collider for cutting solid substances in the collided material flow.

2. The nanomaterial processing system as claimed in claim 1, further comprising a magnetizer provided between said material feeder and said shunt collider and adapted to magnetize the high-pressure material flow passing from said material feeder to said shunt collider.

3. The nanomaterial processing system as claimed in claim 1, wherein said 5 compressor means comprises filter means installed in said inlet.

4. The nanomaterial processing system as claimed in claim 1, wherein said material feeder comprises a pressure gauge adapted to measure the pressure of the high-pressure flow of air/liquid passing through.

5. The nanomaterial processing system as claimed in claim 1, further comprising a gas source connected to the inlet of said compressor means and adapted to add a gas into the flow of air/liquid guided into said compressor means.

* * * * *